US006824401B2

(12) United States Patent
Kuo et al.

(10) Patent No.: US 6,824,401 B2
(45) Date of Patent: Nov. 30, 2004

(54) CABLE END CONNECTOR ASSEMBLY AND METHOD OF ASSEMBLING THE ASSEMBLY

(75) Inventors: Chin Pao Kuo, Tu-Chen (TW); Shih Tung Chang, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/317,608

(22) Filed: Dec. 11, 2002

(65) Prior Publication Data

US 2004/0097111 A1 May 20, 2004

(30) Foreign Application Priority Data

Nov. 15, 2002 (TW) ..... 91133435

(51) Int. Cl.[7] ..... H01R 4/66
(52) U.S. Cl. ..... 439/92
(58) Field of Search ..... 439/92, 496, 329, 439/67, 493, 502, 623, 497, 98, 610, 99; 174/36, 117 F

(56) References Cited

U.S. PATENT DOCUMENTS 4,565,417 A * 1/1986 Dussel et al. ..... 439/94 C
5,030,794 A 7/1991 Schell et al.
5,091,604 A * 2/1992 Kirma ..... 174/2
5,184,960 A * 2/1993 Hopkins et al. ..... 439/35
5,387,113 A 2/1995 Dickerson et al.
5,956,445 A * 9/1999 Deitz, Sr. et al. ..... 385/100
6,394,839 B2 * 5/2002 Reed ..... 439/497
6,462,268 B1 * 10/2002 Hazy et al. ..... 174/36

* cited by examiner

*Primary Examiner*—P. Austin Bradley
*Assistant Examiner*—Phuongchi Nguyen
(74) *Attorney, Agent, or Firm*—Wei Te Chung

(57) ABSTRACT

A cable end connector assembly (10) and a method of assembling the cable end connector assembly are disclosed. The cable end connector assembly includes a first connector (20), a second connector (21), a plurality of first transmitting cables (30) connected between the first connector and the second connector, a grounding ring (50) electrically connecting with the first connector by a first grounding wire (300), a second grounding wire (35) one end thereof connecting with the second connector, a foil (40) covering with the first transmitting cables and electrically connecting with the second grounding wire, a first conductive tape (62) wrapping the first transmitting cables, the first grounding wire, and the foil therein and electrically connecting with the first grounding wire and the foil.

18 Claims, 11 Drawing Sheets

CABLE END CONNECTOR ASSEMBLY AND METHOD OF ASSEMBLING THE ASSEMBLY

BACKGROUND OF THE INVENTION

1. Field of the Invention

The present invention relates to a cable end connector assembly and a method of assembling the assembly, and particularly to a cable end connector assembly connecting with a liquid crystal display (LCD) for reducing Electromagnetic Interference (EMI) and the method of assembling the assembly.

2. Description of Related Art

A cable end connector assembly is used in a liquid crystal display (LCD), a notebook computer, and a desktop computer so as for transmitting high speed signals. In the past, some electrical shielding tapes are used in shielding the cable for preventing Electromagnetic Interference (EMI). U.S. Pat. No. 5,030,794 and U.S. Pat. No. 5,387,113 disclose some copper or aluminum foils and conductive tapes wrapped around the cables for shielding noise from influencing. Referring to FIG. 10, a cable end connector assembly comprises a connector 1, a plurality of wires 2, and a conductive tape 3. The wires comprise a plurality of signal wires and grounding wires. The grounding wires do not electrically connect with the conductive tape 3, and the conductive tape 3 is not grounded. Referring to FIG. 11, the cable end connector assembly further comprises a grounding ring 4 and electrically connects with a conductive tape 3 by another conductive tape 400 so as for providing an effective grounding. However, the grounding resistance of using conductive tape is so large that the shielding and grounding against EMI is not good. Therefore, in order to achieve effective shielding and grounding against EMI, an improved shielding and grounding way need to be contributed.

SUMMARY OF THE INVENTION

Accordingly, a first object of the present invention is to provide a cable end connector assembly which can achieve an effective shielding and grounding against EMI.

A second object of the present invention is to provide a method of assembling the cable end connector assembly which can achieve an effective shielding and grounding against EMI.

In order to achieve the objects set forth, a cable end connector assembly comprises a first connector, a second connector, a plurality of first transmitting cables connected between the first connector and the second connector, a grounding ring electrically connecting with the first connector by a first grounding wire, a second grounding wire one end thereof connecting with the second connector, a foil covering with the first transmitting cables and electrically connecting with the second grounding wire, a first conductive tape wrapping the first transmitting cables, the first grounding wire, and the foil therein and electrically connecting with the first grounding wire and the foil.

A method of assembling a cable end connector assembly comprising the steps: (a) providing a first connector, a second connector, a plurality of first transmitting cables connecting the first connector with the second connector, a grounding ring mechanically and electrically connecting with the first connector by a first grounding wire, a second grounding wire connecting with the second connector; (b) providing a foil covering on the first transmitting cables and electrically connecting with the second grounding wire; (c) wrapping the first transmitting cables, the first grounding wire, one end of the foil in a first conductive tape, the first conductive tape electrically connecting with the first grounding wire and the foil.

Other objects, advantages and novel features of the invention will become more apparent from the following detailed description when taken in conjunction with the accompanying drawings.

DETAILED DESCRIPTION OF THE INVENTION

Figure 1:
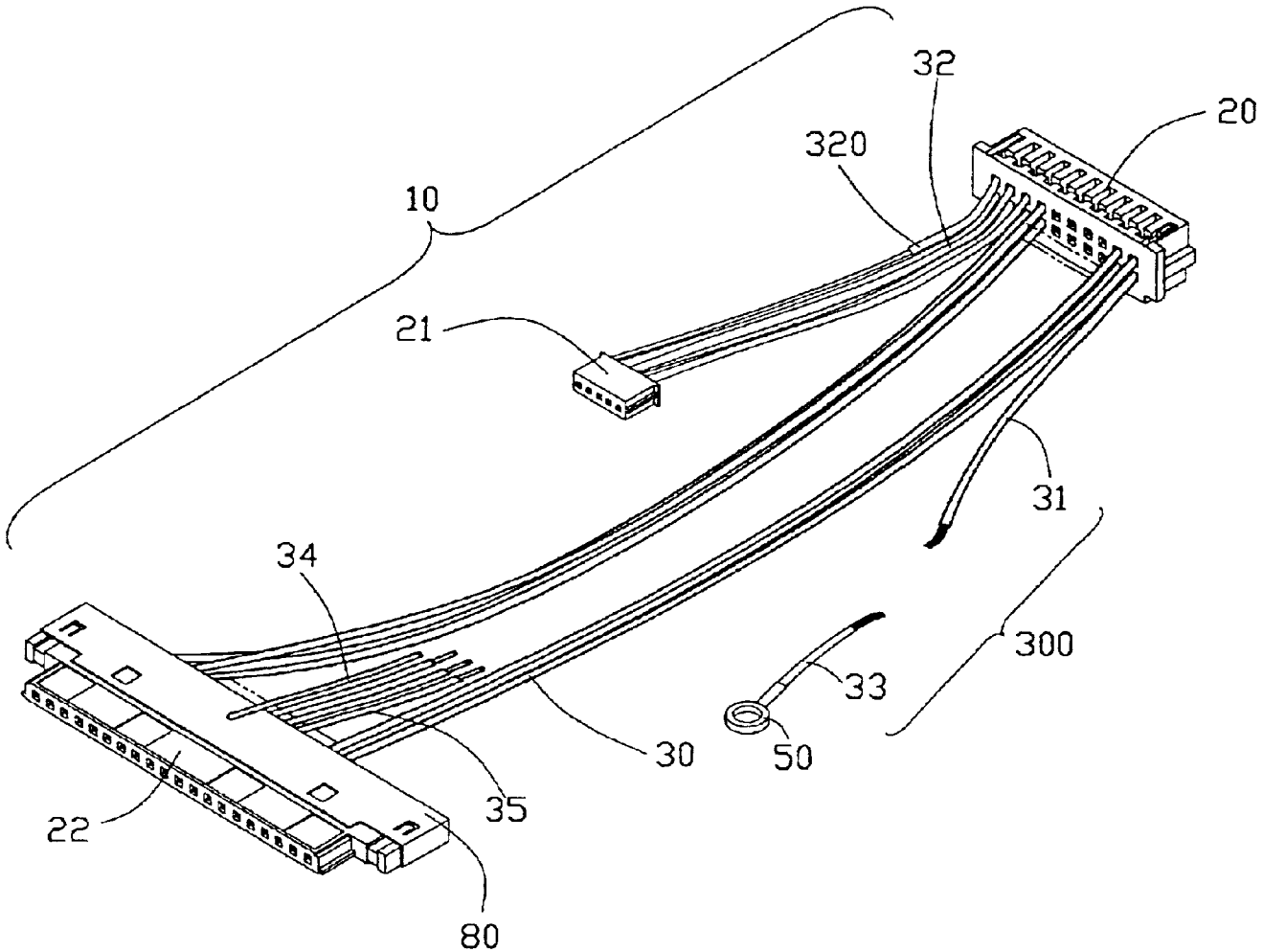
FIG. 1 is a partly assembled view of a cable end connector assembly without wrapping any conductive tape.
Figure 2:
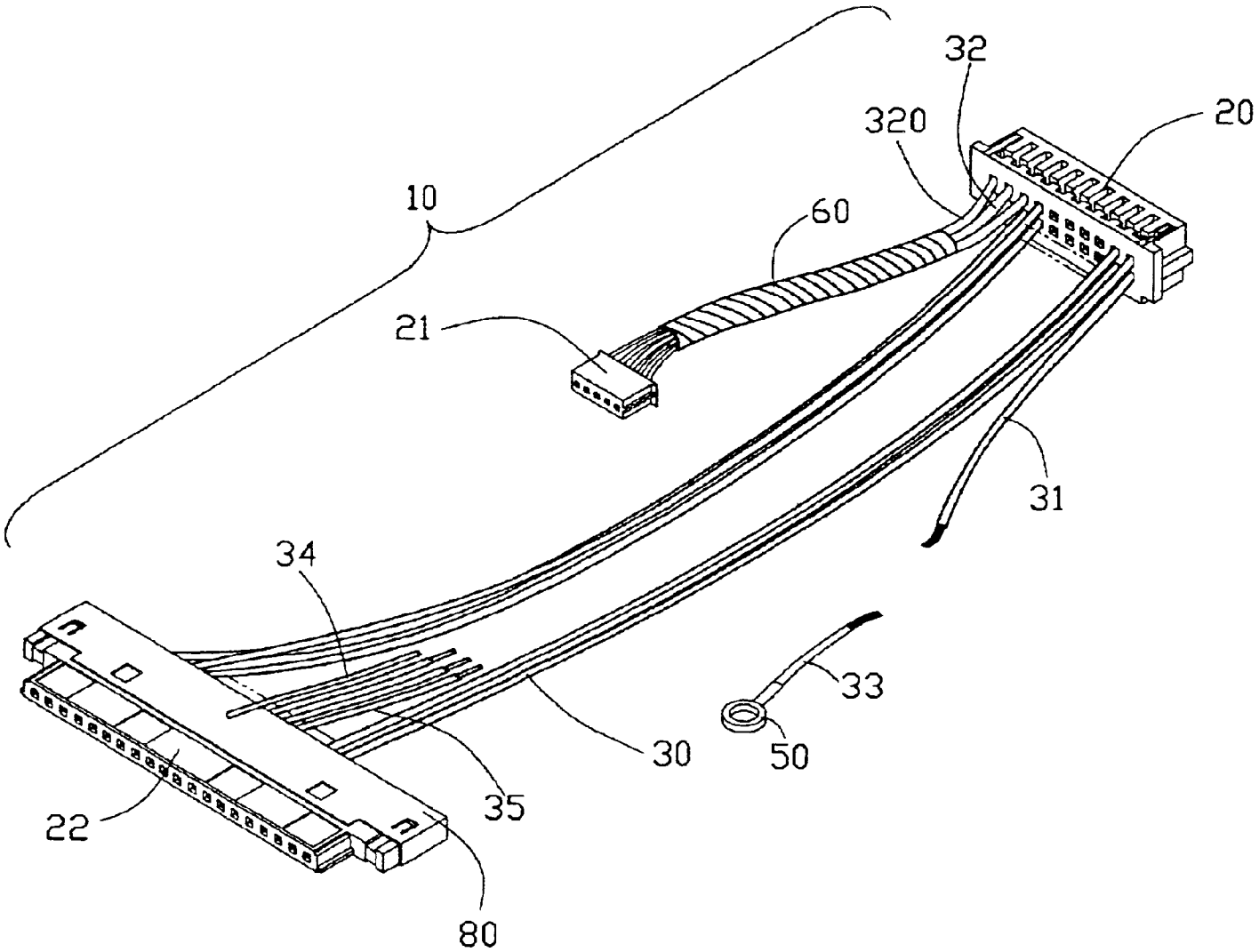
FIG. 2 is a partly assembled view of the cable end connector assembly showing a second conductive tape wrapping a plurality of second transmitting cables and a third grounding wire therein.

Referring to FIG. 1, a cable end connector assembly 10 of the present invention comprises a first connector 20, a second connector 22, a plurality of first transmitting cables 30 connecting with the first connector 20, a third connector 21, and a plurality of second transmitting cables 32 connecting the first connector 20 with the third connector 21. The first, the second and the third connectors each connector comprise a plurality of conductive contacts (not shown) received in the connectors. The first transmitting cables are mechanically and electrically connected to the contacts of the first connector 20 and the contacts of the second connector 22. The plurality of second transmitting cables 32 are mechanically and electrically connected to the contacts of the first connector 20 and the contacts of the third connector 21.

The cable end connector assembly 10 further comprises a first grounding wire 300 which includes a first segment 31 mechanically and electrically connecting with the contacts of the first connector 20, a second segment 33 mechanically and electrically connects with a grounding ring 50. Free ends of the first and the segments 31 and 33 of the first grounding wire 300 are skinned for exposing conductors (not labeled) outside jackets (not labeled) of the first and second segments 31 and 33. A plurality of second grounding wires 35 one end of each second grounding wire 35 mechanically and electrically connects with the contact of the second connector 22. A bare wire 34 one end thereof soldered with an out surface of a conductive shield 80 of the second connector 22. A third grounding wire 320 one end thereof mechanically and electrically connects with contact of the first connector 20 and the other end thereof mechanically and electrically connects with the contact of the third connector 21. A middle portion of the third grounding wire 320 is skinned to expose the conductive conductor.

A second conductive tape 60 wraps the second transmitting cables 32 and the third grounding wire 320 therein and electrically connects with the third grounding wire 320.

Figure 3:
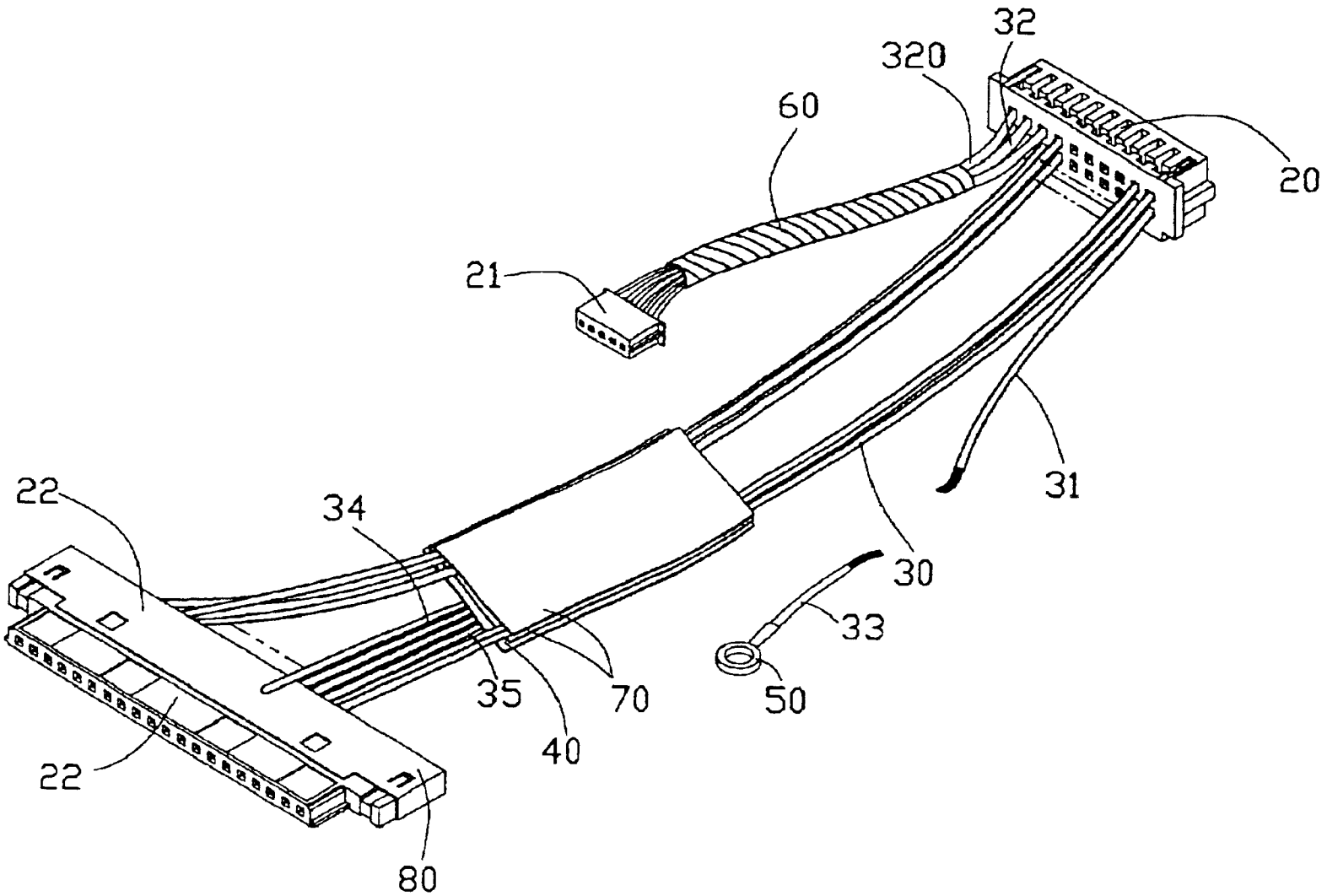
FIG. 3 is a partly assembled view of the cable end connector assembly showing a foil covering on the first transmitting cables.

Referring to FIG. 3, the plurality of first transmitting cables 30 is arranged in one row. A pair of adhesive tapes 70 is attached on two sides of the row of the first transmitting cables. A foil 40 covers to an out surface of one tape 70.

Figure 4:
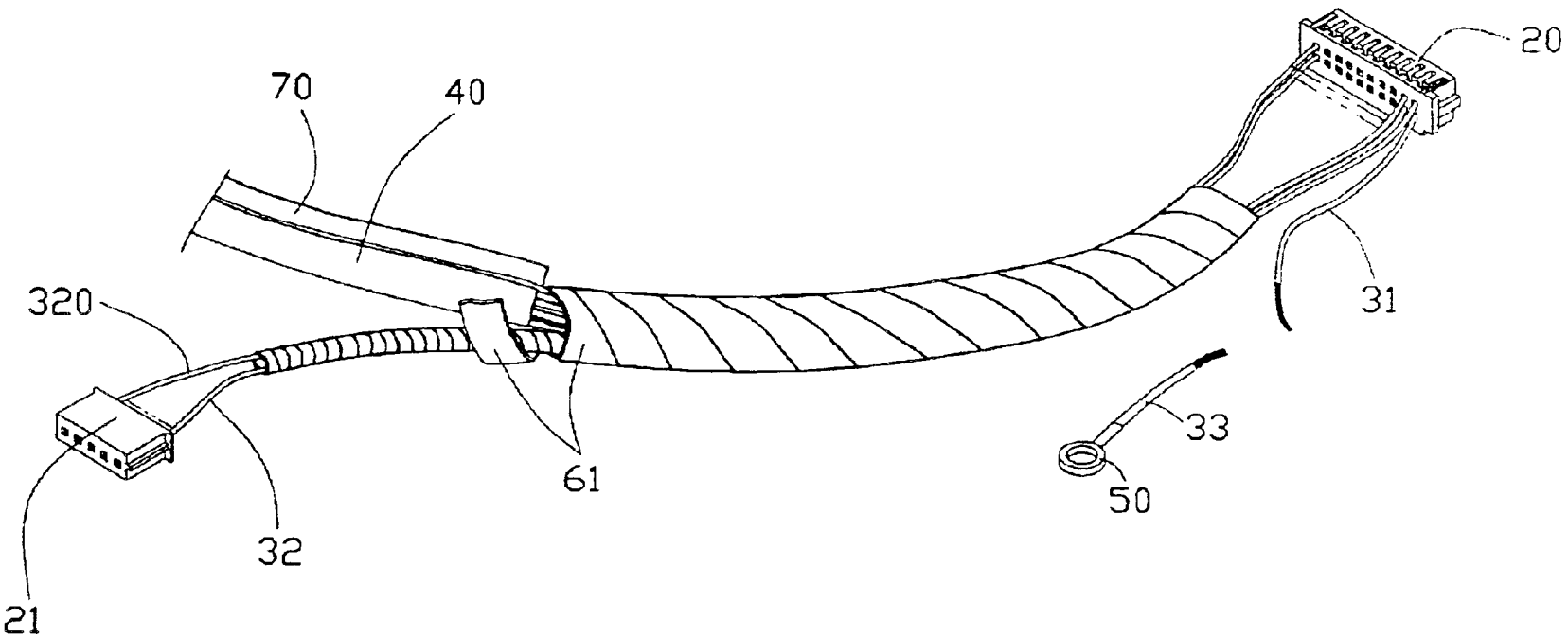
FIG. 4 is a partly assembled view of the cable end connector assembly showing a third conductive tape wrapping the second conductive tape, the first transmitting cables therein.

Referring to FIG. 4, the second conductive tape 60 with the second transmitting cables 32 and the third grounding wire 320 in the second conductive tape 60, the first transmitting cables 30 are wrapped in a third conductive tape 61. The second conductive tape 60 electrically connects with the third conductive tape 61.

Figure 5:
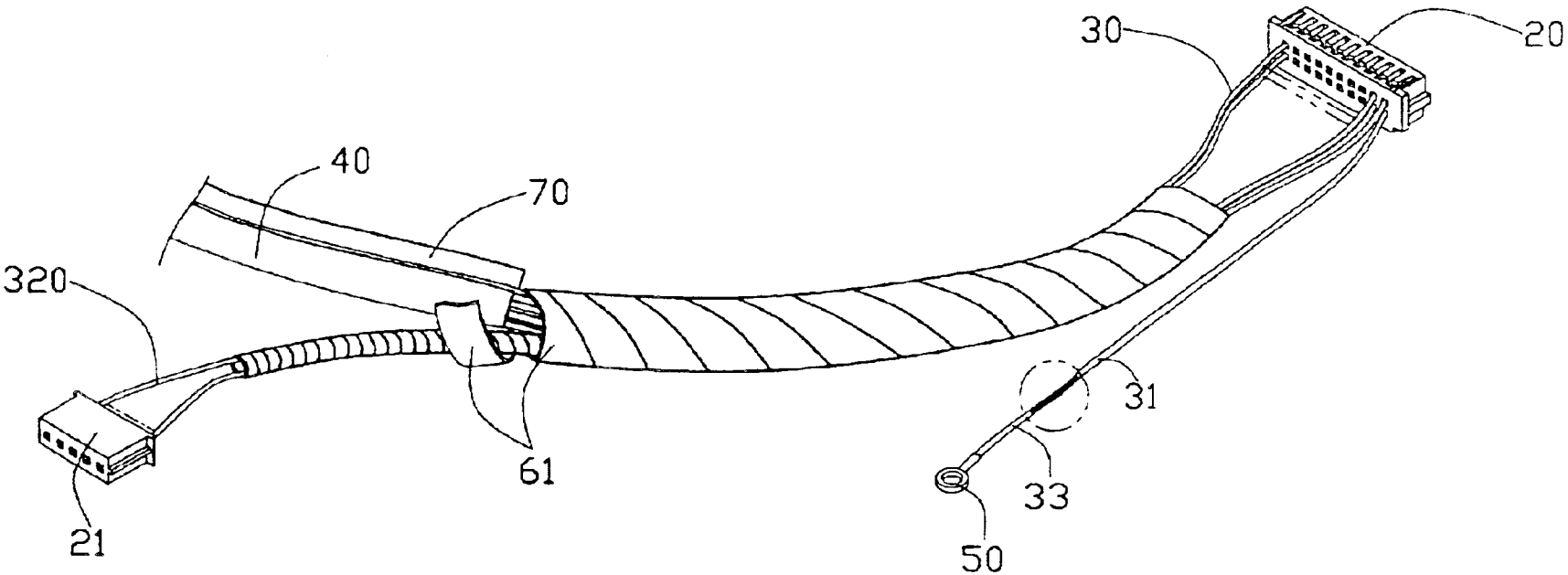
FIG. 5 is a partly assembled view of the cable end connector assembly showing a first segment of a first grounding wire mechanically and electrically connecting with a second segment of the first grounding wire.
Figure 6:
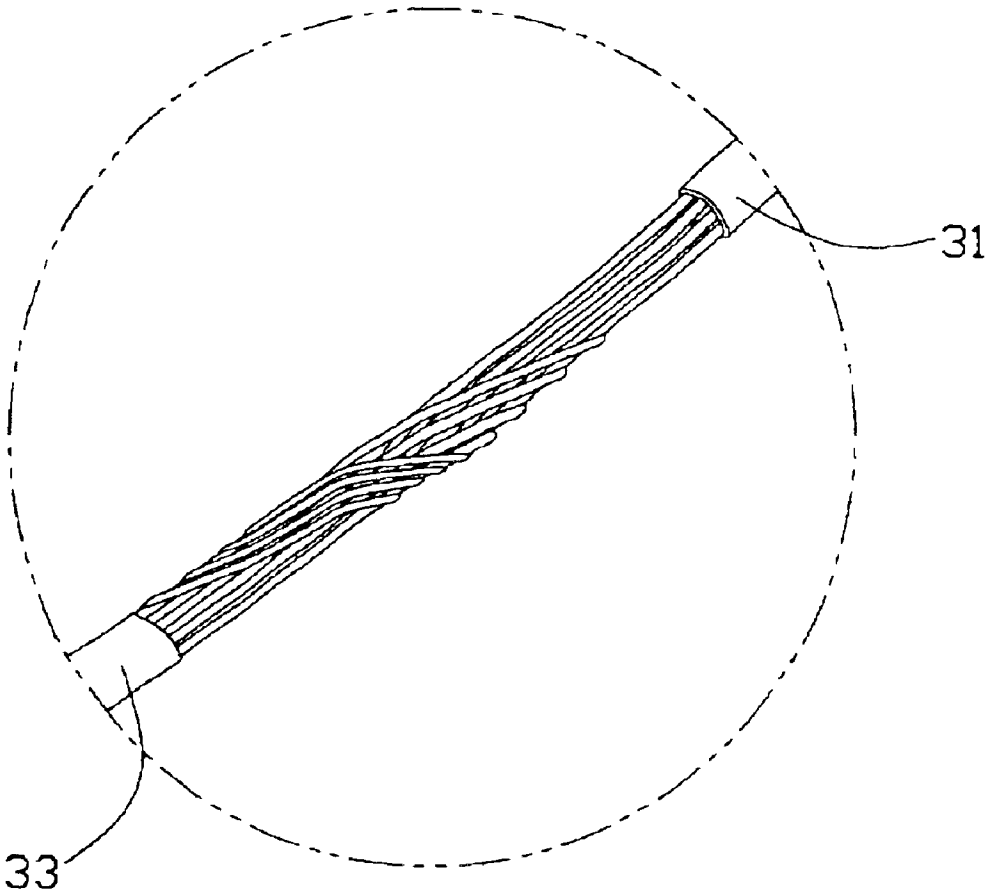
FIG. 6 is an enlarged view of the cable end connector assembly showing the first segment mechanically and electrically connecting with a second segment of the first grounding wire.

Referring to FIGS. 5 and 6, the conductor of the first segment 31 of the first grounding wire is intertwisted with the conductor of the second segment 32 of the first grounding wire so that the first segment 31 mechanically and electrically connects with the second segment 33.

Figure 7:
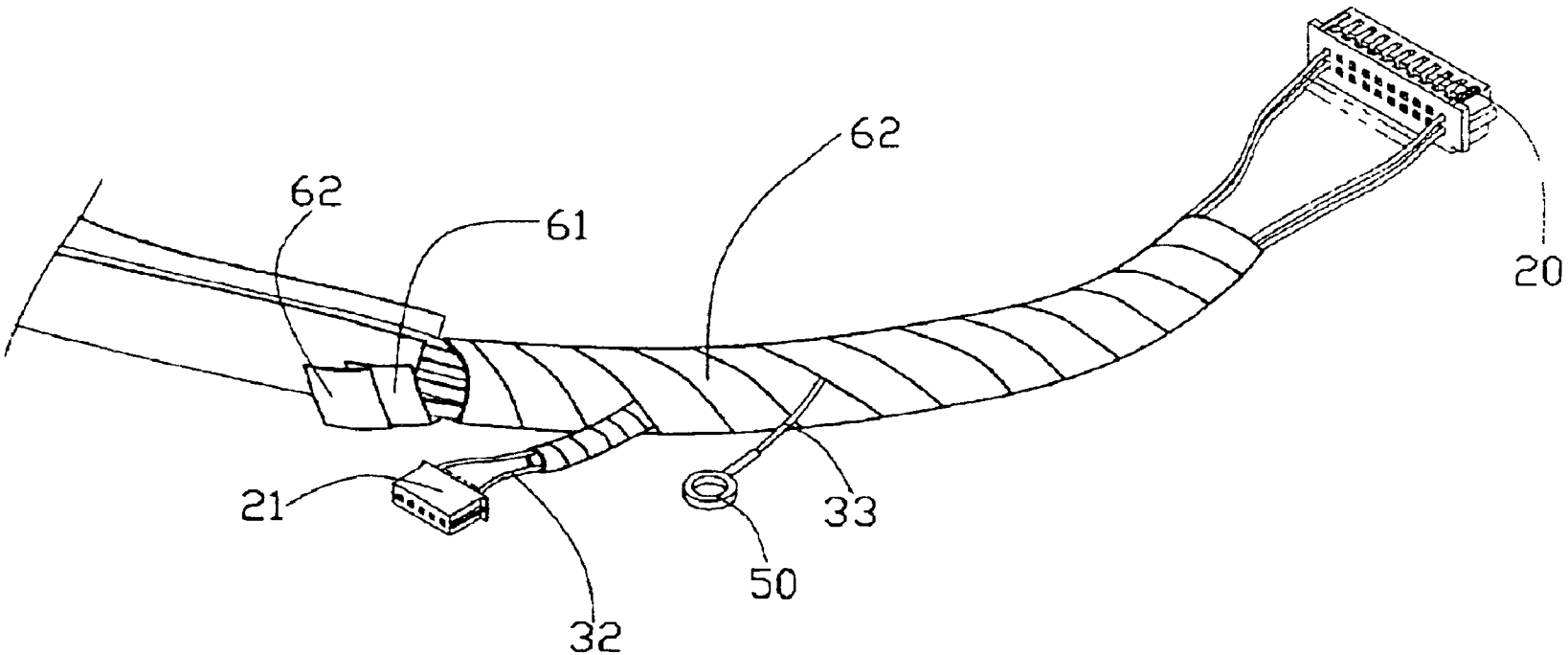
FIG. 7 is a partly assembled view of the cable end connector assembly showing a first conductive tape wrapping the third conductive tape, the first grounding wire therein and electrically connecting with the foil.

Referring to FIG. 7, the third conductive tape 61 with the first transmitting cables 30, the second conductive tape 60 with the second transmitting cables 32 and the second grounding wire 320 therein, the first grounding wire 300, and one end of the foil 40 are wrapped in a first conductive tape 62. The first conductive tape 62 electrically connects with the third conductive tape 61 and the foil 40.

Figure 8:
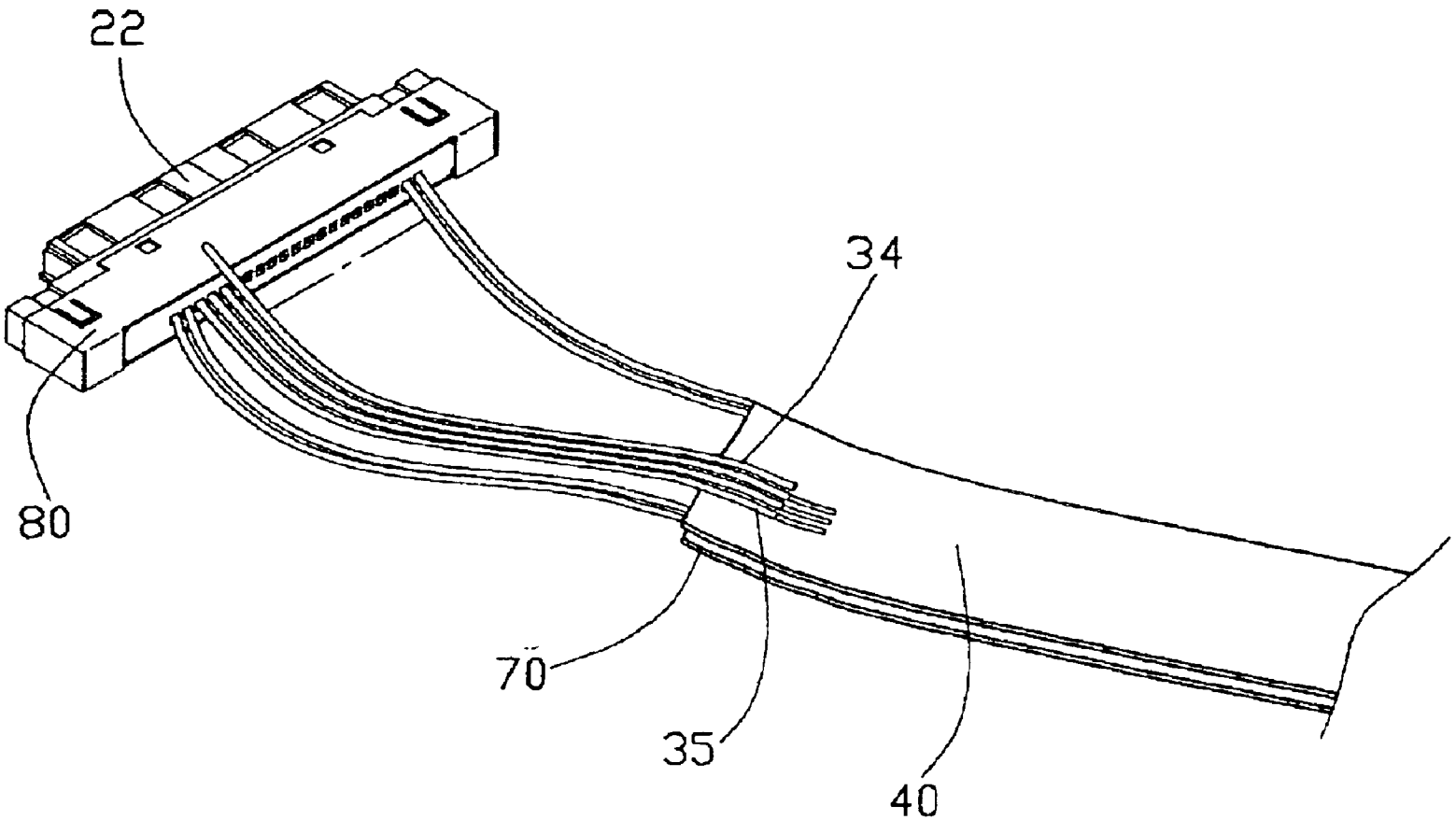
FIG. 8 is a partly assembled view of the cable end connector assembly showing a second grounding wire and a bare wire soldering with the foil.

Referring to FIG. 8, the bare wire 34 and the second grounding wires 35 are soldered to the foil 40.

Figure 9:
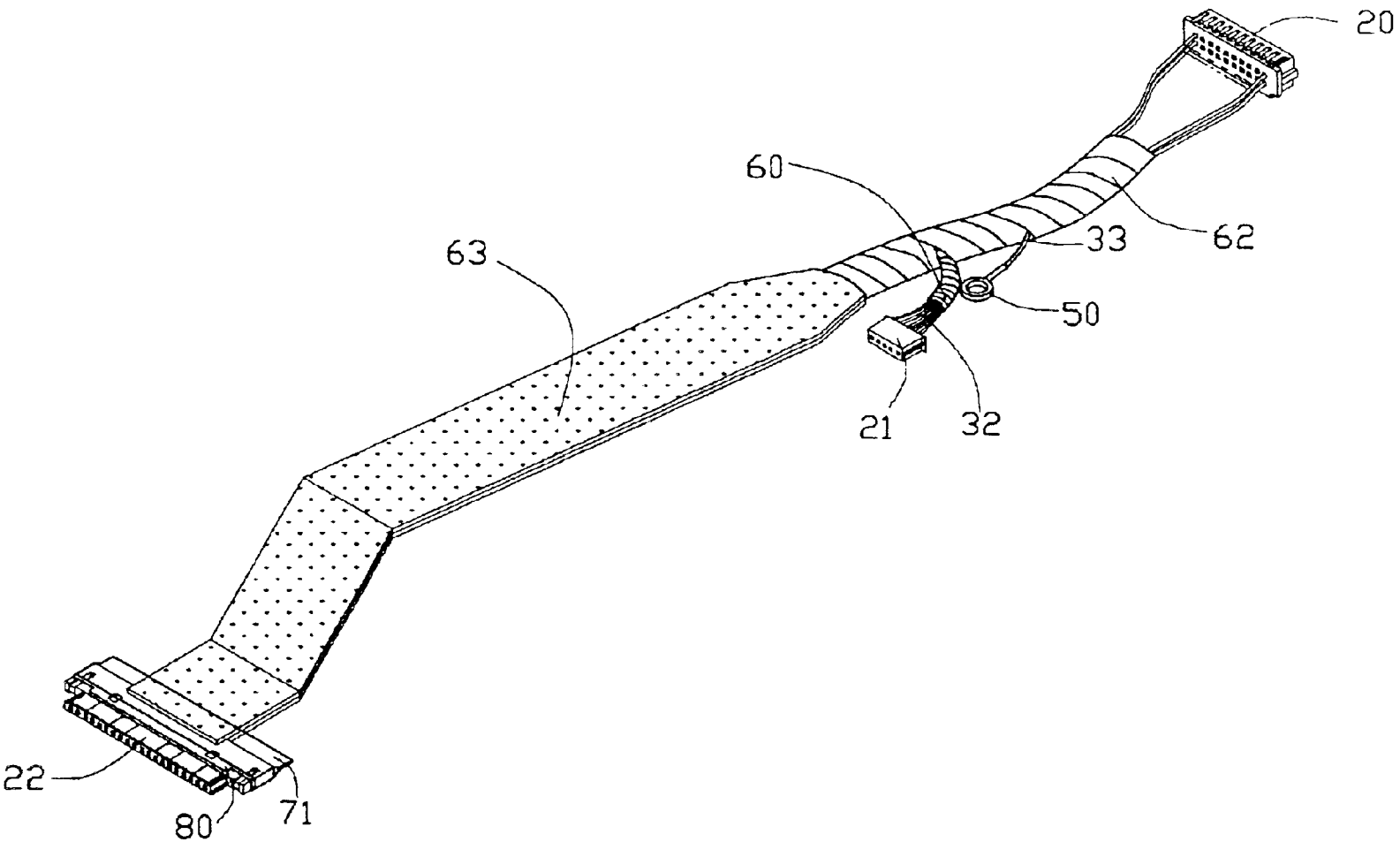
FIG. 9 is an assembled view of the cable end connector assembly showing a fourth conductive tape wrapping the first conductive tape, the foil therein and electrically connecting with a conductive shield of a second connector.
Figure 10:
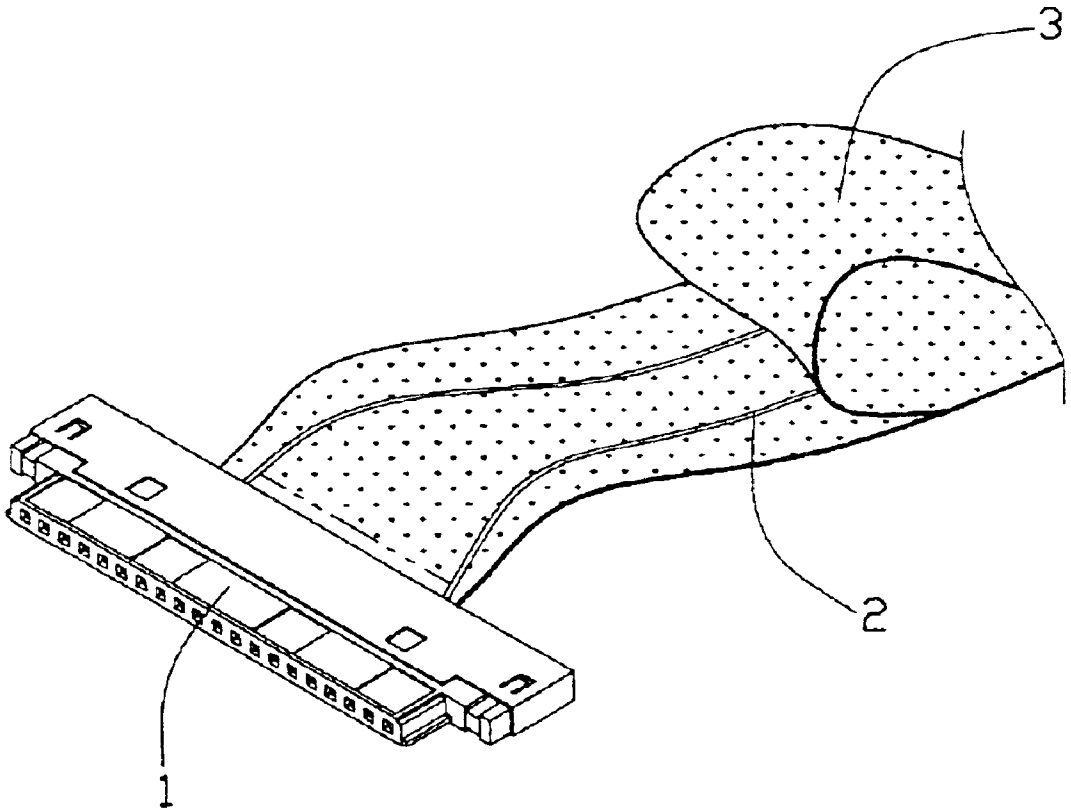
FIG. 10 (PRIOR ART)
FIG. 10 is a perspective assembled view of a first conventional cable end connector assembly.
Figure 11:
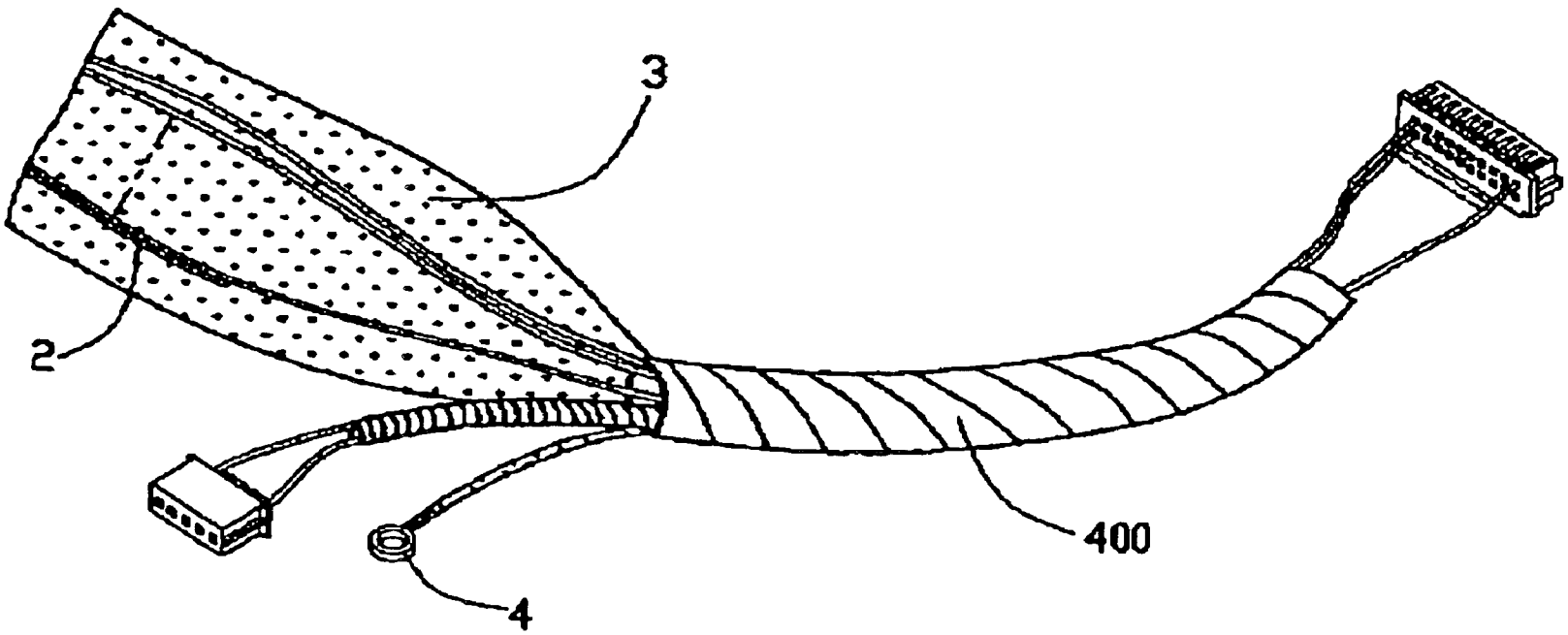
FIG. 11 (PRIOR ART)
FIG. 11 is a perspective assembled view of a second conventional cable end connector assembly.

Referring to FIG. 9, a fourth conductive tape 63 wraps one end of the first conductive tape 62 and the foil 40 and electrically connects with the conductive shield 80 of the second connector 22.

Because the first grounding wire 300 is electrically connected with the contacts in the first connector 20, the grounding ring 50, and the third conductive tape 61; the second grounding wire 35 is connected with the contacts of the second connector 22 and the foil 40; the bare wire 34 is electrically connected with the shield 80 of the second connector 22 and the foil 40; the foil 40 is electrically connected with the first conductive tape 62; the third grounding wire 320 is electrically connected with the first connector 20, the third connector 21, and the second conductive tape 60. The first, the second, the third, and the fourth conductive tapes 62, 60, 61 and 63 are electrically connected, so that a grounding path is established. EMI raisesed by other electromagnetic interference source acts on the transmitting cables and the shield is grounded by the contacts of the connectors 20, 21 and 22 mating with other connectors (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

a first connector;

a second connector;

a plurality of first transmitting cables connected between the first connector and the second connector;

a grounding ring electrically connecting with the first connector by a first grounding wire;

a second grounding wire one end thereof connecting with the second connector;

a foil covering with the first transmitting cables and electrically connecting with the second grounding wire; and a first conductive cloth wrapping the first transmitting cables, the first grounding wire, and the foil therein and the first conductive cloth electrically connecting with the first grounding wire and the foil.

2. The cable end connector assembly as described in claim 3, wherein the first transmitting cables are arranged in one row and the foil is covered on one side of the row of the first cables.

3. The cable end connector assembly as described in claim 1, further comprising a conductive shield enclosing the second connector therein, a bare wire electrically connecting with the conductive shield and the foil.

4. The cable end connector assembly as described in claim 3, wherein the first grounding wire is skinned bare wire electrically connecting with the conductive cloth.

5. The cable end connector assembly as described in claim 4, wherein the first grounding wire comprises a first segment mechanically and electrically connected to the first connector, a second segment connected with the grounding ring, the first segment mechanically and electrically connects with the second segment.

6. The cable end connector assembly as described in claim 3, further comprising a third connector, a plurality of second transmitting cables connecting the first connector with the third connector, a third grounding wire connecting the first connector with the third connector.

7. The cable end connector assembly as described in claim 6, further comprising a second conductive cloth wrapping the second transmitting cables and the third grounding wire therein and the second conductive cloth electrically connects with the third grounding wire.

8. The cable end connector assembly as described in claim 7, wherein the third grounding wire is a half bare wire connecting the first connector and the third connector.

9. The cable end connector assembly as described in claim 8, further comprising a third conductive cloth wrapping the first transmitting cables, the second conductive cloth therein, the second conductive cloth electrically connects with the third conductive cloth.

10. The cable end connector assembly as described in claim 9, wherein the first conductive cloth wraps the third conductive cloth and the first grounding wire therein and covers one end of the foil, the first conductive cloth electrically connects with the third conductive cloth and the foil.

11. The cable end connector assembly as described in claim 10, further comprising a fourth conductive cloth wrapping one end of the first conductive cloth, the foil, and electrically connecting with the conductive shield of the second connector.

12. A method of assembling a cable end connector assembly comprising the steps:

(a) providing a first connector, a second connector, a plurality of first transmitting cables connecting the first connector with the second connector, a grounding ring mechanically and electrically connecting with the first connector by a first grounding wire, a second grounding wire connecting with the second connector;

(b) covering a foil on the first transmitting cables and electrically connecting with the second grounding wire;

(c) wrapping the first transmitting cables, the first grounding wire, one end of the foil in a first conductive cloth, the first conductive cloth electrically connecting with the first grounding wire and the foil.

13. The method of assembling the cable end connector assembly as described in claim 12, further comprising the step of providing a conductive shield enclosing on the second connector, a bare wire one end thereof electrically connecting with the conductive shield and the other end thereof electrically connecting with the foil.

14. The method of assembling the cable end connector assembly as described in claim 13, further comprising the step of providing a third connector, a plurality of second transmitting cables connecting the first connector with the third connector, a third grounding wire connecting the first connector with the third connector.

15. The method of assembling the cable end connector assembly as described in claim 14, further comprising the step of wrapping the second transmitting cables, the third grounding wire in a second conductive cloth, the third grounding wire electrically connecting with the second conductive cloth.

16. The method of assembling the cable end connector assembly as described in claim 15, further comprising the step of wrapping the first transmitting cables, the second conductive cloth in a third conductive cloth, the second conductive cloth electrically connecting with the third conductive cloth.

17. The method of assembling the cable end connector assembly as described in claim 16, wherein the third conductive cloth, the first grounding wire, and one end of the foil are wrapped in the first conductive cloth.

18. The method of assembling the cable end connector assembly as described in claim 17, further comprising the step of providing a fourth conductive cloth wrapping one end of the first conductive cloth and the foil therein and electrically connecting with the conductive shield.

* * * * *